US011255342B2

(12) United States Patent
Lee

(10) Patent No.: US 11,255,342 B2
(45) Date of Patent: Feb. 22, 2022

(54) HIGH-POWERED SANITARY PUMP

(71) Applicant: Hyung Bok Lee, Gyeonggi-do (KR)

(72) Inventor: Hyung Bok Lee, Gyeonggi-do (KR)

( * ) Notice: Subject to any disclaimer, the term of this patent is extended or adjusted under 35 U.S.C. 154(b) by 0 days.

(21) Appl. No.: 17/076,390

(22) Filed: Oct. 21, 2020

(65) Prior Publication Data

US 2021/0123455 A1 Apr. 29, 2021

(30) Foreign Application Priority Data

Oct. 25, 2019 (KR) ..... 10-2019-0133624

(51) Int. Cl.

| | |
|---|---|
| ***F04D 29/42*** | (2006.01) |
| ***F04D 13/06*** | (2006.01) |
| ***F04D 29/62*** | (2006.01) |
| ***F04D 7/04*** | (2006.01) |
| ***F04D 29/60*** | (2006.01) |
| ***F04D 13/02*** | (2006.01) |
| ***F04D 29/08*** | (2006.01) |
| ***F04D 29/22*** | (2006.01) |

(52) U.S. Cl.

CPC ..... *F04D 29/426* (2013.01); *F04D 7/04* (2013.01); *F04D 13/021* (2013.01); *F04D 13/06* (2013.01); *F04D 29/08* (2013.01); *F04D 29/605* (2013.01); *F04D 29/628* (2013.01); *F04D 29/2222* (2013.01); *F04D 29/2255* (2013.01); *F05D 2260/31* (2013.01)

(58) Field of Classification Search

CPC ..... F04D 29/426; F04D 7/04; F04D 13/021; F04D 13/06; F04D 29/08; F04D 29/605; F04D 29/628; F04D 29/2222; F04D 29/2255; F05D 2260/31

See application file for complete search history.

(56) References Cited

U.S. PATENT DOCUMENTS

| | | | | |
|---|---|---|---|---|
| 1,809,526 A * | 6/1931 | Namur | F04D 29/628 416/186 R |
| 1,991,761 A * | 2/1935 | McHugh | F04D 29/628 415/201 |
| 3,873,242 A * | 3/1975 | Anderson | F04D 7/06 417/360 |
| 5,195,867 A * | 3/1993 | Stirling | F04D 29/061 415/111 |

(Continued)

FOREIGN PATENT DOCUMENTS

| | | |
|---|---|---|
| JP | 2004245056 | 9/2004 |
| JP | 2012161526 | 8/2012 |

(Continued)

*Primary Examiner* — Peter J Bertheaud

(74) *Attorney, Agent, or Firm* — IPLA P.A.; James E. Bame

(57) ABSTRACT

A high-powered sanitary pump includes an impeller (20) axially mounted inside a case (10) and rotating by a motor (M) in order to inhale and discharge fluid by a rotational centrifugal force of the impeller. The impeller (20) has discharge pipes (22) radially connected to the cylindrical inhalation groove part (21) so as to be able to run at low noise and at low vibration and provide high performance with high pump-up head and flow rate while inhaling and discharging fluid not by forced pressure that forcedly pushes the fluid by a conventional rotor blade but by pressure inducing a gentle flow, by high pressure or by vacuum pressure.

2 Claims, 6 Drawing Sheets

(56) References Cited

U.S. PATENT DOCUMENTS

| | | | | |
|---|---|---|---|---|
| 5,489,187 | A * | 2/1996 | Ray | B01F 3/04617 415/111 |
| 9,239,057 | B2 * | 1/2016 | Hoshi | F04D 13/02 |

FOREIGN PATENT DOCUMENTS

| | | |
|---|---|---|
| JP | 2014084767 | 5/2014 |
| KR | 20000009909 | 2/2000 |
| KR | 1020060039836 | 5/2006 |
| KR | 101743008 | 5/2017 |
| KR | 102129695 | 6/2020 |

* cited by examiner

HIGH-POWERED SANITARY PUMP

BACKGROUND

The present invention relates to a high-powered sanitary pump for inhaling and discharging fluid by a rotational centrifugal force of an impeller, and more particularly, to a high-powered sanitary pump, which can run at low noise and at low vibration and provide high performance with high pump-up head and flow rate while inhaling and discharging fluid not by forced pressure that forcedly pushes the impeller by a conventional rotor blade but by pressure inducing a gentle flow through discharge pipes radially formed on the circumference of an inhalation groove part and by high pressure.

In general, pumps are divided into various kinds, such as a reciprocating pump, a rotary pump, a centrifugal pump, an axial-flow pump, a friction pump, and others according to structures and uses. The centrifugal pump is one of pumps which are used the most in the industry field.

The centrifugal pump has a passage of a spiral form formed outside a rotating impeller so that fluid entering the central part of the centrifugal pump through an inlet passes the rotating impeller and is discharged to the external circumference while pressure gets higher, and then, passes the spiral passage and is discharged to a pump outlet.

The impeller of the conventional centrifugal pump has rotor blades radially formed on the circumference in a curved form at equal angles and inhales and discharges the fluid by centrifugal force while rotating the rotor blades in a state where the rotor blades abuts on a cover on the front surface of a case. Because the rotor blades of the impeller inhale and discharge the fluid while forcedly pushing the fluid, lots of vibration and noise are generated by frictional shock on the fluid and it is difficult to realize high performance by high pump-up head and flow rate.

As described above, lots of technical efforts to precisely design rotor blades of an impeller have been made in order to reduce vibration and noise caused by the operation of the impeller of the pump and to improve efficiency. However, such efforts have a limit in that they cannot fundamentally solve the problems of vibration, noise and performance since the rotor blades of the impeller forcedly push the fluid.

Patent Document 1: Korean Utility Model Publication No. 20-1991-2819 (Feb. 25, 1992)

Patent Document 2: Korean Patent Publication No. 10-2006-39836 (May 9, 2006)

SUMMARY OF THE INVENTION

Accordingly, the present invention has been made to solve the above-mentioned problems occurring in the prior arts, and it is an object of the present invention to provide a high-powered sanitary pump, which can run at low noise and at low vibration and provide high performance with high pump-up head and flow rate while inhaling and discharging fluid not by forced pressure that forcedly pushes the impeller by a conventional rotor blade but by pressure inducing a gentle flow through discharge pipes radially formed on the circumference of an inhalation groove part and by high pressure.

It is another object of the present invention to provide a high-powered sanitary pump which can simply control a direction of an outlet of a case from which fluid is discharged in a state where the pump is installed, thereby enhancing efficiency in use.

To accomplish the above object, according to the present invention, there is provided a high-powered sanitary pump including: a case; and an impeller axially combined with a driving shaft of a motor inside the case so that fluid is induced to an inlet at the front of the case and is discharged to an outlet on the circumference of the case by centrifugal force through rotation of the impeller, the impeller including a cylindrical inhalation groove part formed at the rear of the inlet of the case and discharge pipes radially formed on the circumference of the inhalation groove part and respectively having discharge holes, thereby inhaling and discharge the fluid not by forced pressure that forcedly pushes the fluid but by pressure inducing a gentle flow when the impeller rotates.

According to the present invention, the front of a cover housing for covering the outside of the driving shaft of the motor and the rear of the case are coupled with each other by assembly bolts, and coupling holes of the cover housing are formed in a long hole shape and the cover housing is coupled with the case while the coupling holes are rotated between the assembly bolts. The case includes an assembly stepped groove formed at the front thereof and a cover having the outlet is inserted and coupled to protrude out of the assembly stepped groove, and a screw hole formed on the outer face of the assembly stepped groove in such a way that a fastening bolt having a head for pressing and fastening the rim of the cover is coupled with a screw hole so as to rotate and control a direction of the outlet of the case in the state where the pump is installed.

According to the present invention, the high-powered sanitary pump includes an impeller axially mounted inside the case and rotating by the motor in order to inhale and discharge fluid by a rotational centrifugal force of the impeller. The impeller has discharge pipes radially connected to the cylindrical inhalation groove part so as to be able to run at low noise and at low vibration and provide high performance with high pump-up head and flow rate while inhaling and discharging fluid not by forced pressure that forcedly pushes the fluid by a conventional rotor blade but by pressure inducing a gentle flow, by high pressure or by vacuum pressure.

Furthermore, the high-powered sanitary pump can simply control a direction of the outlet of the case from which fluid is discharged in the state where the pump is installed, thereby enhancing efficiency in use.

BRIEF DESCRIPTION OF THE DRAWINGS

The above and other objects, features and advantages of the present invention will be apparent from the following detailed description of the preferred embodiments of the invention in conjunction with the accompanying drawings, in which.

DETAILED DESCRIPTION OF THE PREFERRED EMBODIMENT

Hereinafter, an embodiment of the present invention will be described in detail with reference to the accompanying drawings.

Figure 1:
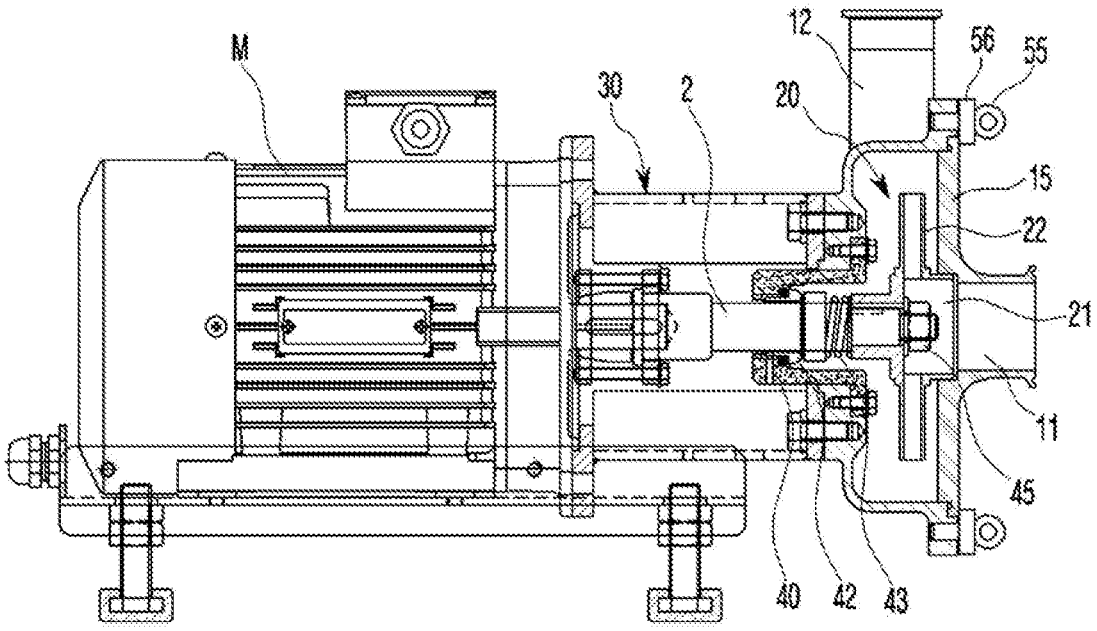
FIG. 1 is a front sectional view showing a high-powered sanitary pump according to an embodiment of the present invention.
Figure 2:
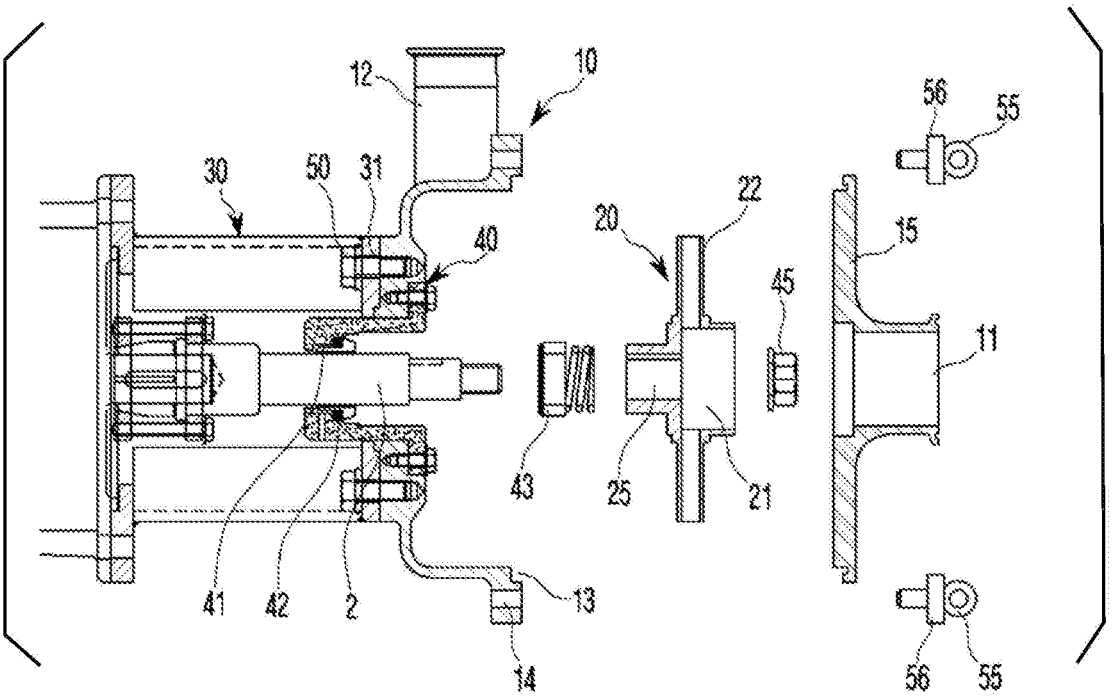
FIG. 2 is an exploded sectional view of essential parts of FIG. 1.
Figure 3:
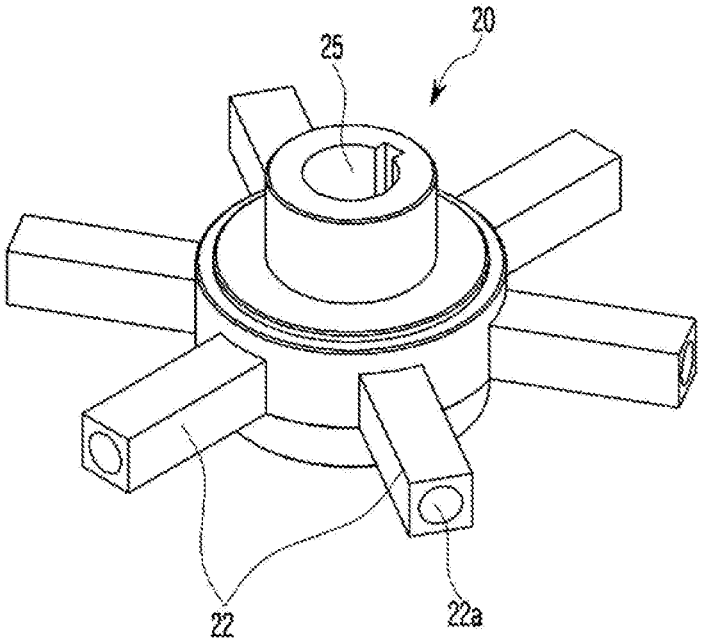
FIG. 3 is a perspective view showing an impeller of the present invention.
Figure 4:
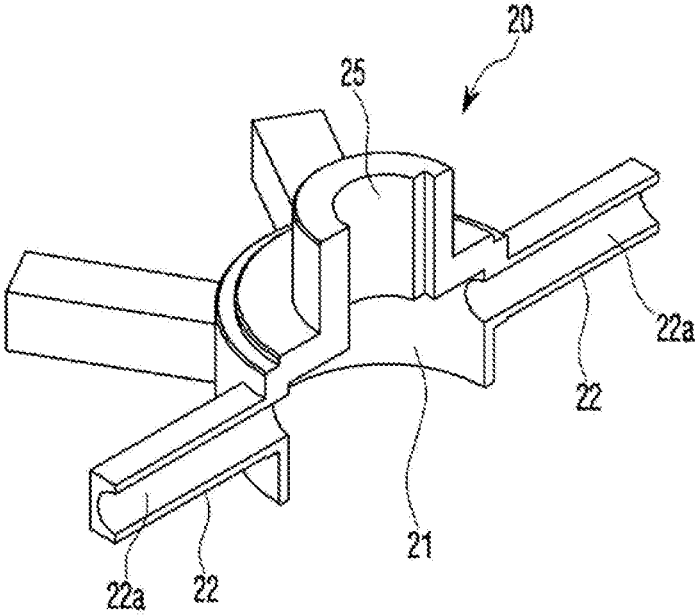
FIG. 4 is a sectionally perspective view of FIG. 3.
Figure 5:
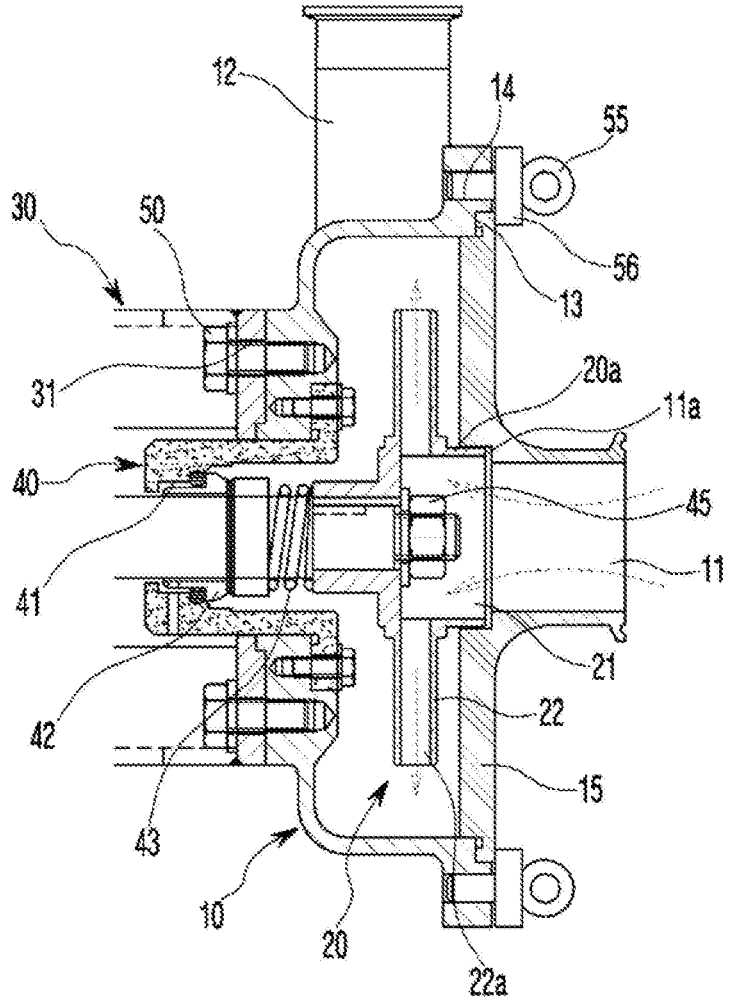
FIG. 5 is an enlarged view of the essential parts of FIG. 1.
Figure 6:
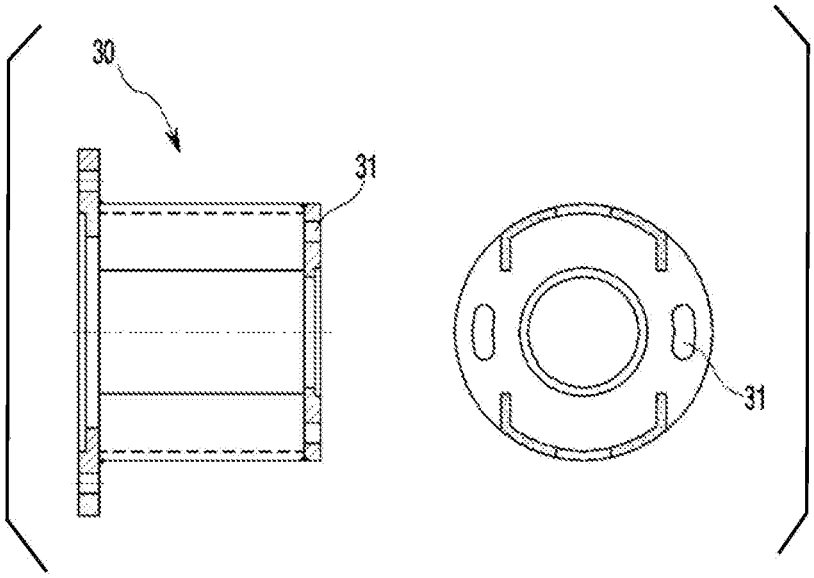
FIG. 6 is a front view and a side view of a cover housing according to the present invention.
Figure 7:
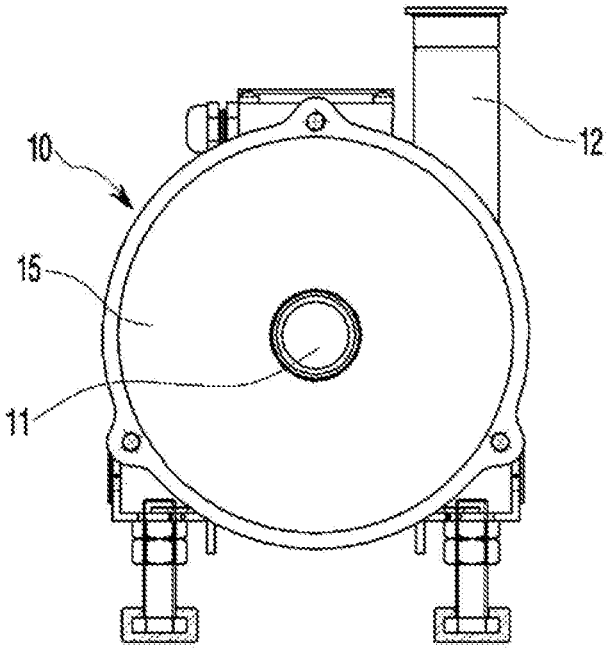
FIGS. 7 to 11 are side views showing states where a case is rotated and combined in order to control a direction of an outlet according to various embodiments of the present invention.
Figure 8:
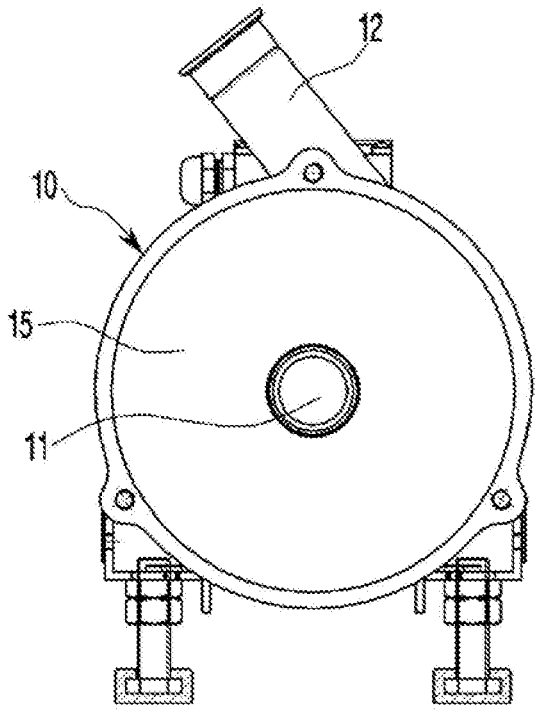
Figure 9:
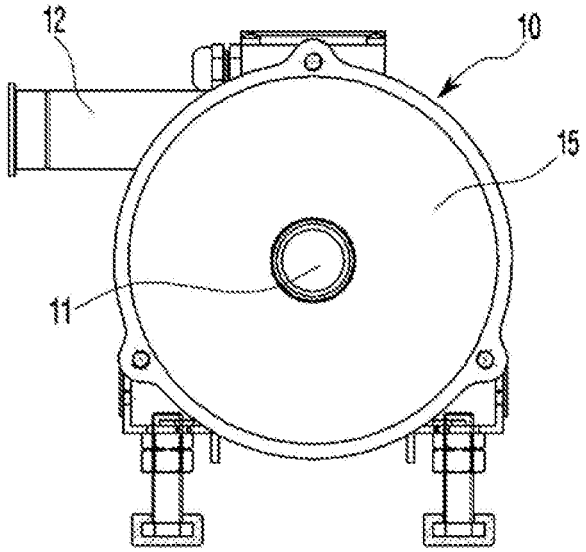
Figure 10:
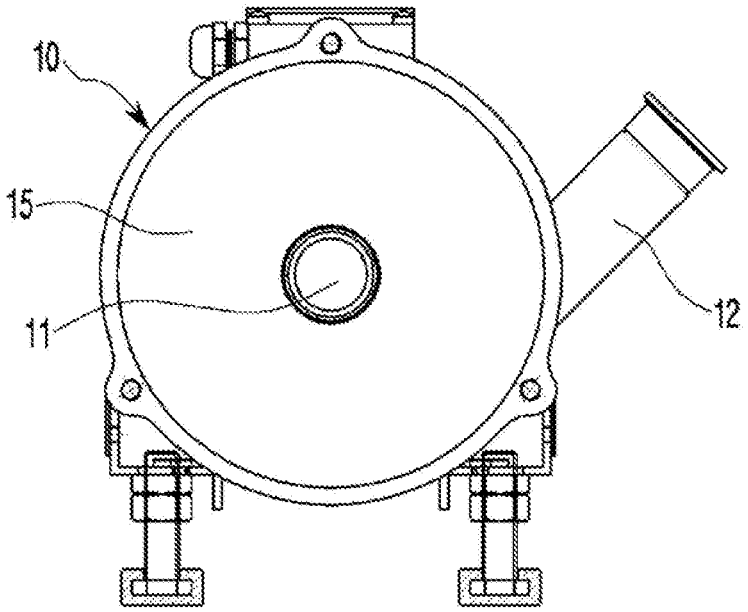
Figure 11:
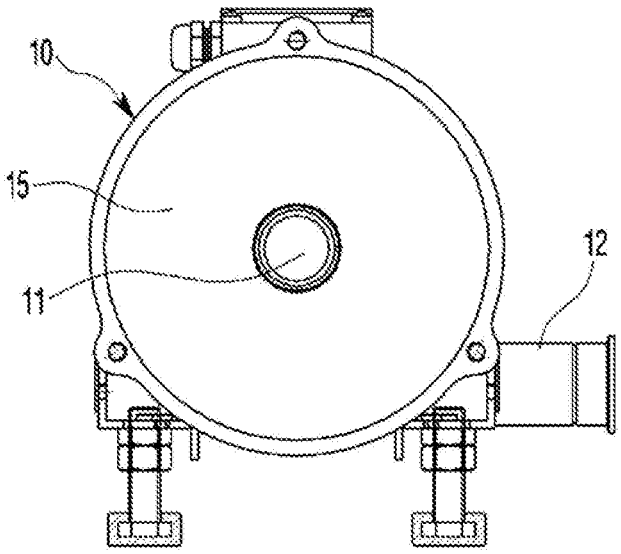

As shown in FIGS. 1 to 11, a high-powered sanitary pump includes a case 10 and an impeller 20 axially combined with a driving shaft 2 of a motor M in the case 10 so as to induce fluid into an inlet 11 of the front surface of the case and discharge the fluid to an outlet 12 on the circumference by centrifugal force through rotation of the impeller and to discharge the fluid to an outlet 12 on the circumference.

Especially, the impeller 20 includes a cylindrical inhalation groove part 21 formed at the rear of the inlet 11 of the case and discharge pipes 22 radially formed on the circumference of the inhalation groove part and having discharge holes 22*a* respectively formed in the discharge pipes so that the impeller does not forcedly push the fluid but inhales and discharges the fluid by pressure inducing a gentle flow when the impeller rotates.

In this instance, the front center of a body 20*a* of the impeller 20 is inserted into a stepped part 11*a* in the inlet 11 to engage with the stepped part 11*a* and the inhalation groove part 21 of the impeller has a space partitioned from the outside, so that the fluid induced through the inlet is radially discharged to the discharge holes 22*a* through the inhalation groove part 21. Moreover, while the impeller 20 inhales and discharges the fluid not by forced pressure to forcedly push the fluid through the conventional rotor blades but by pressure inducing a gentle flow and by high pressure or vacuum pressure, the pump can run at low noise and low vibration and show high performance with high pump-up head and flow rate.

Additionally, preferably, the inner discharge holes 22*a* of the discharge pipes 22 of the impeller respectively have circular cross-sections, and the exteriors of the discharge pipes respectively have square or circular cross-sections. In the drawings, six discharge pipes are formed on the circumference of the impeller 20 at equal angles, but four to eight discharge pipes may be formed on the circumference of the impeller 20, namely, the number of the discharge pipes can be increased or decreased.

Moreover, in the state where the pump is installed, the direction of the outlet 12 of the case can be rotated and controlled. That is, the front of a cover housing 30 for covering the outside of the driving shaft 2 of the motor and the rear of the case 10 are coupled with each other by assembly bolts 50. Coupling holes 31 of the cover housing are formed in a long hole shape, and the cover housing is coupled with the case while the coupling holes are rotated between the assembly bolts. The case 10 includes an assembly stepped groove 13 formed at the front thereof and a cover 15 having the outlet 12 is inserted and coupled to protrude out of the assembly stepped groove 13. The case has a screw hole 14 formed on the outer face of the assembly stepped groove and a fastening bolt 55 having a head 56 to press and fasten the rim of the cover 15 is coupled with the screw hole 14 so as to rotate and control the direction of the outlet 12 of the case in the state where the pump is installed.

In this instance, the assembly bolts 50 for assembling the case 10 are coupled at intervals of 90 degrees and the coupling holes 31 of the cover housing are formed in a long hole shape within a range of 20 to 45 degrees, so that the outlet 12 of the case rotates within the angle range of the coupling holes at intervals of 90 degrees or about 90 degrees in order to rotate and control the direction of the outlet 12 of the case.

Furthermore, a seal housing 40 which is put onto the driving shaft is coupled with the inner center of the case 10, and a seal ring 42 with sealability getting in contact with a stepped portion 41 in the seal housing, a buffer spring 43 and a shaft hole 25 of the impeller are put onto the driving shaft 2 to be fixed and combined by a nut 45 while resiliently coming in contact with each other.

Next, an operation and an action of the present invention will be described.

The pump according to the present invention includes the impeller 20 axially mounted on the driving shaft 2 of the motor M inside the case 10, and induces fluid into the inlet 11 at the front of the case and discharges the fluid to the outlet 12 formed on the circumference by centrifugal force through rotation of the impeller.

Especially, the impeller 20 of the present invention inhales all of the fluid induced into the inlet 11 of the front center of the case to the inhalation groove part 21 of the front of the impeller 20.

In this instance, the front center of the body 20*a* of the impeller is inserted into the stepped part 11*a* in the inlet 11 to engage with the stepped part 11*a* so as to inhale all of the fluid induced into the inlet 11 to the inhalation groove part 21.

The fluid induced into the inhalation groove part 21 by centrifugal force through rotation of the impeller 20 is radially discharged through the discharge holes 22*a* of the discharge pipes 22 radially connected to the inhalation groove part. In this instance, because the fluid is inhaled and discharged not by forced pressure to forcedly push the fluid through the rotor blades of the conventional impeller but by pressure inducing a natural flow of the fluid through the inhalation groove part and the discharge pipes at high pressure or vacuum pressure, the high-powered sanitary pump according to the present invention can remarkably reduce noise or vibration to run at low noise and low vibration and can show high performance with high pump-up head and flow rate.

As described above, the fluid discharged by rotational centrifugal force of the impeller 20 is discharged through the outlet 12 of the case.

In the meantime, in the state where the pump is installed, the direction of the outlet 12 of the case may be changed. First, the assembly bolt 50 which fastens the front of the cover housing 30 and the rear of the case 10 is released.

Next, the fastening bolt 55 fastening the front of the case 10 is loosened so that the cover 15 at the front of the case is released.

As described above, the case 10 is released from the fastened state at the front and the rear thereof, and then, is rotated and controlled according to the installation direction of the outlet 12.

In this instance, the case 10 is rotated at an interval that the cover housing 30 and the case 10 are coupled by the assembly bolt 50, namely, at the interval of 90 degrees, in order to control the angle, or is rotated within an angle range that the assembly bolt 50 is rotated in the coupling hole 31 of the long hole shape in the state where the assembly bolt 50 is inserted into the coupling hole 31 of the cover housing (see FIGS. 7 to 11).

While the seal housing 40 combined with the inside of the case is rotated in a state where it is close to the seal ring 42 or the seal ring and the buffer spring 43 are rotated in a state where they are resiliently close to each other to maintain the axially coupled center, the rotation of the case 10 is controlled.

As described, when the rotation of the case 10 is finished, the case and the cover housing 30 are coupled with each other by the assembly bolt 50 again to be fastened, the fastening bolt 55 is connected to the front of the case 10, so that the case and the cover 15 are coupled and fastened while the head 56 of the fastening bolt presses the cover 15.

Therefore, the high-powered sanitary pump according to the present invention, which includes the impeller axially mounted inside the case and rotating by the motor M, inhales and discharges fluid by rotational centrifugal force of the impeller. The impeller has discharge pipes radially connected to the cylindrical inhalation groove part so as to be able to run at low noise and at low vibration and provide high performance with high pump-up head and flow rate while inhaling and discharging fluid not by forced pressure that forcedly pushes the fluid by a conventional rotor blade but by pressure inducing a gentle flow. Furthermore, the high-powered sanitary pump can simply control a direction of the outlet of the case from which fluid is discharged in the state where the pump is installed, thereby enhancing efficiency in use.

What is claimed is:

1. A high-powered sanitary pump comprising:

a case; and an impeller axially combined with a driving shaft of a motor inside the case so that fluid is induced to an inlet at a front of the case and is discharged to an outlet on the circumference of the case by centrifugal force through rotation of the impeller, the impeller including a cylindrical inhalation groove part formed at a rear of the inlet of the case and discharge pipes radially formed on the circumference of the inhalation groove part and respectively having discharge holes, wherein a front of a cover housing for covering an outside of the driving shaft of the motor and a rear of the case are coupled with each other by assembly bolts, and coupling holes of the cover housing are formed in a long hole shape and the cover housing is coupled with the case such that the coupling holes can be rotated between the assembly bolts, and wherein the case includes an assembly stepped groove formed at the front thereof and a cover having the outlet is inserted and coupled to protrude out of the assembly stepped groove, and a screw hole formed on an outer face of the assembly stepped groove in such a way that a fastening bolt having a head for pressing and fastening a rim of the cover is coupled with a screw hole so as to rotate and control a direction of the outlet of the case in the state where the pump is installed, thereby inhaling and discharging the fluid not by forced pressure that forcedly pushes the fluid but by pressure inducing a gentle flow when the impeller rotates.

2. The high-powered sanitary pump according to claim 1, wherein a seal housing which is put onto the driving shaft is coupled with an inner center of the case, and a seal ring with sealability getting in contact with a stepped portion in the seal housing, a buffer spring, and a shaft hole of the impeller are put onto the driving shaft to be fixed and combined by a nut.

* * * * *